US009744408B2

(12) United States Patent
Kamino et al.

(10) Patent No.: US 9,744,408 B2
(45) Date of Patent: Aug. 29, 2017

(54) GOLF BALL

(75) Inventors: Kazuya Kamino, Kobe (JP); Keiji Ohama, Kobe (JP)

(73) Assignee: DUNLOP SPORTS CO. LTD., Kobe-Shi, Hyogo (JP)

( * ) Notice: Subject to any disclaimer, the term of this patent is extended or adjusted under 35 U.S.C. 154(b) by 973 days.

(21) Appl. No.: 13/454,550

(22) Filed: Apr. 24, 2012

(65) Prior Publication Data

US 2012/0208655 A1 Aug. 16, 2012

Related U.S. Application Data

(63) Continuation of application No. 12/232,371, filed on Sep. 16, 2008.

(30) Foreign Application Priority Data

Oct. 23, 2007 (JP) ..... 2007-274682

(51) Int. Cl.
*A63B 37/06* (2006.01)
*A63B 37/12* (2006.01)
*A63B 37/00* (2006.01)

(52) U.S. Cl.
CPC ..... *A63B 37/12* (2013.01); *A63B 37/0003* (2013.01); *A63B 37/0031* (2013.01); *A63B 37/0033* (2013.01); *A63B 37/0038* (2013.01); *A63B 37/0022* (2013.01)

(58) Field of Classification Search
CPC ..... A63B 37/0022
USPC ..... 473/378, 373, 374
See application file for complete search history.

(56) References Cited

U.S. PATENT DOCUMENTS

| | | | |
|---|---|---|---|
| 5,695,414 | A | 12/1997 | Yokota et al. |
| 5,902,190 | A | 5/1999 | Masutani et al. |
| 6,488,596 | B1 | 12/2002 | Maruoka et al. |
| 2003/0120020 | A1 | 6/2003 | Yokota et al. |
| 2003/0176242 | A1 | 9/2003 | Mano |
| 2005/0215355 | A1 | 9/2005 | Nagasaki et al. |

(Continued)

FOREIGN PATENT DOCUMENTS

| | | | |
|---|---|---|---|
| JP | 8-322961 | A | 12/1996 |
| JP | 9-276445 | A | 10/1997 |

(Continued)

OTHER PUBLICATIONS

Japanese Office Action of Japanese Application No. 2007-274682 dated Mar. 6, 2012.

(Continued)

*Primary Examiner* — Raeann Gorden
(74) *Attorney, Agent, or Firm* — Birch, Stewart, Kolasch & Birch, LLP

(57) ABSTRACT

Golf ball 2 of the present invention has core 4, cover 10 situated on the external side of the core 4, and paint layer 16 provided to cover this cover 10. The base polymer of the cover 10 is a urethane resin. The base polymer of the paint layer 16 is a urethane resin. The cover 10 has a thickness Tc of 0.1 mm or greater and 0.7 mm or less. The paint layer 16 has a thickness Tp (mm) of 0.015 mm or greater and 0.040 mm or less. The ratio (Tp/Tc) is 0.021 or greater and 0.40 or less. Preferably, the paint layer 16 is formed with two or more layers 18 and 20. Preferably, the base polymer of the paint layer 16 is a two-pack type urethane resin or a two-pack type epoxy resin.

20 Claims, 1 Drawing Sheet

(56) References Cited

U.S. PATENT DOCUMENTS

| | | | | |
|---|---|---|---|---|
| 2005/0261085 | A1 | 11/2005 | Sasaki | |
| 2006/0030428 | A1* | 2/2006 | Ohira | 473/378 |

FOREIGN PATENT DOCUMENTS

| | | | |
|---|---|---|---|
| JP | 2000-176047 | A | 6/2000 |
| JP | 2003-154034 | A | 5/2003 |
| JP | 2003-265650 | A | 9/2003 |
| JP | 2005-270333 | A | 10/2005 |
| JP | 2005-334026 | A | 12/2005 |
| JP | 2005-342165 | A | 12/2005 |

OTHER PUBLICATIONS

Japanese Office Action with the partial English translation dated Dec. 13, 2011, for Application No. 2007-274682.

* cited by examiner

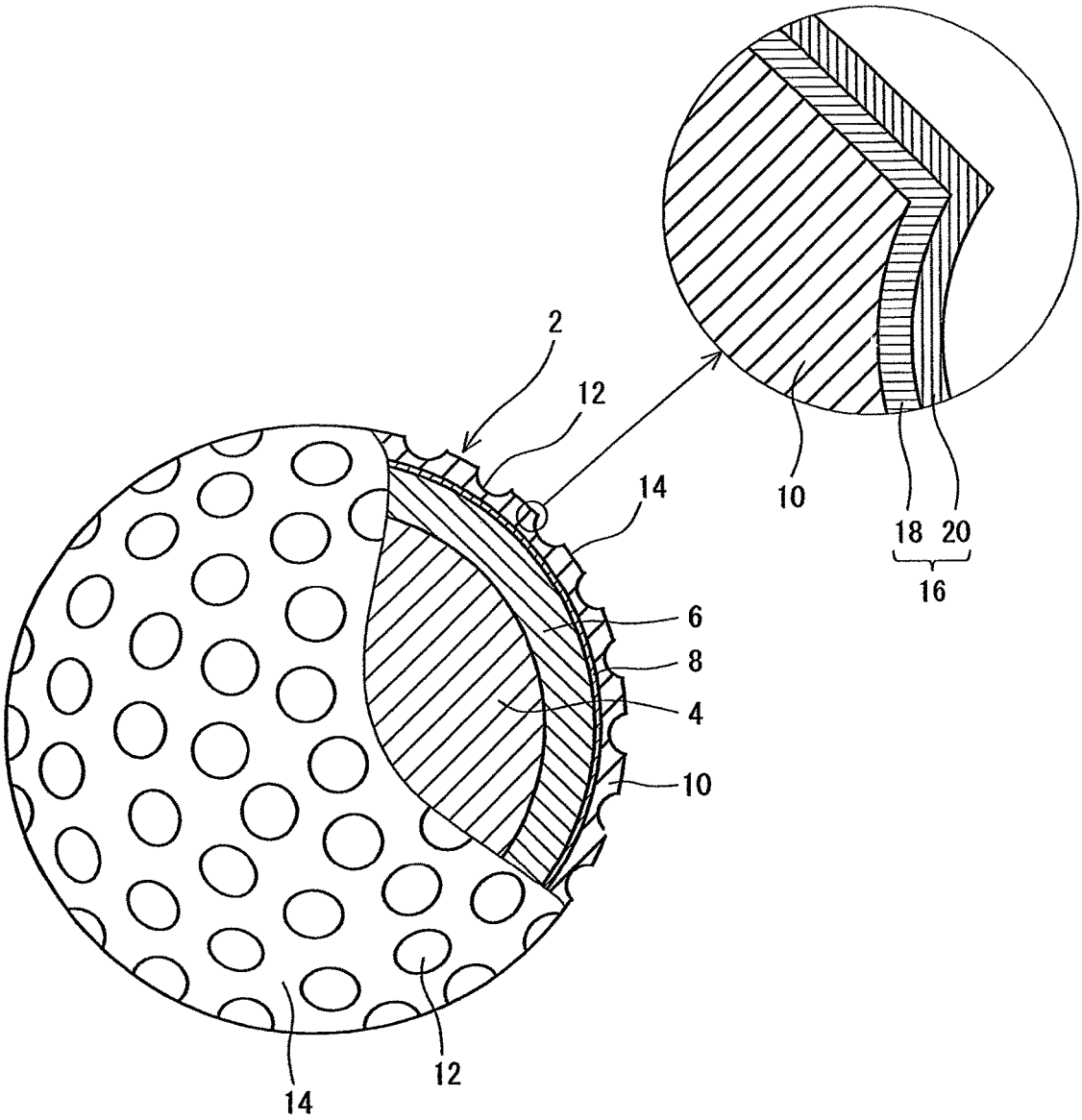
2
12
14
10
18
20
16
6
8
4
10
14
12

GOLF BALL

This application is a Continuation of co-pending application Ser. No. 12/232,371, filed on Sep. 16, 2008. Priority is claimed to Japanese Patent Application No. 2007-274682 filed on Oct. 23, 2007. The entire contents of this Japanese Patent Application are hereby incorporated by reference.

BACKGROUND OF THE INVENTION

Field of the Invention

The present invention relates to golf balls.

Description of the Related Art

For golf balls, in addition to flight performances, approach performances and spin stability have been demanded. Golf balls having favorable approach performances are accompanied by a great backspin rate upon approach shots. Golf balls that are superior in the spin stability are less likely to be accompanied by variance of the backspin rate. In the golf balls that are superior in spin stability, for example, the difference between dry spin rate Sd and wet spin rate Sw is small. The ratio (Sw/Sd) is also referred to as spin retention, which has been employed as a marker of the spin stability. In particular, high-level golf players tend to place a high priority on approach performances, and spin stability upon approach shots. The dry spin rate Sd means backspin rate in a dry state, while the wet spin rate Sw means a backspin rate in a wet state. The wet state refers to any state in which ball and/or club face get wet with water.

Specifications of coating films (paint layers) can affect the performances of golf balls. In order to improve characteristics of golf balls, golf balls in which thickness and the like of the coating film have been considered were proposed. Japanese Unexamined Patent Application, First Publication No. 2003-265650 (United States Patent Publication No. 2003/176242A1) discloses a golf ball having a favorable spin retention, in which the thickness of the coating film, the 50% modulus of the coating film, and the ratio of the thickness of the coating film and the thickness of the cover are defined. Japanese Unexamined Patent Application, First Publication No. 2000-176047 (U.S. Pat. No. 6,488,596) discloses a golf ball that is excellent in scuff resistance in which the coating film is from 5 to 20 micron. Japanese Unexamined Patent Application, First Publication No. Hei 9-276445 (U.S. Pat. No. 5,902,190) discloses that design freedom of golf balls can be increased by providing a coating film having a thickness of 50 to 700 μm. Japanese Unexamined Patent Application, First Publication No. Hei 8-322961 (U.S. Pat. No. 5,695,414) discloses a golf ball in which the proportion of the depth of the dimple and the average thickness of the coated film that covers the dimple is defined.

SUMMARY OF THE INVENTION

Specifications of the cover can affect the performances of the golf ball. Suitable covers that provide superior the approach performance and spin stability, and also scuff resistance include a polyurethane resin as a base polymer (urethane cover). However, when the thickness of the urethane cover is too large, the backspin rate is increased upon shots with a driver, whereby the flight distance is likely to be decreased. In light of the flight distance upon shots with a driver, it is preferred to minimize the thickness of the urethane cover.

In general, the surface of the cover is provided with a paint layer. Relationship between a thin urethane cover and a paint layer has not been studied in the aforementioned prior arts.

It was revealed that the spin stability upon approach shots and the flight performance upon shots with a driver can be improved by appropriately defining the relationship between the urethane cover and the paint layer.

An object of the present invention is to provide a golf ball which can achieve both the spin stability upon approach shots, and the flight distance upon shots with a driver.

The golf ball according to the present invention has a core, a cover situated on the external side of the core, and a paint layer provided to cover this cover. The base polymer of the cover is a urethane resin. The base polymer of the paint layer is a urethane resin. The cover has a thickness Tc of 0.1 mm or greater and 0.7 mm or less. The paint layer has a thickness Tp (mm) of 0.015 mm or greater and 0.040 mm or less. The ratio (Tp/Tc) is 0.021 or greater and 0.40 or less.

Preferably, the paint layer is formed with two or more layers.

Preferably, the base polymer of the paint layer is a two-pack type urethane resin or a two-pack type epoxy resin.

Preferably, the base polymer of the cover is a thermoplastic polyurethane elastomer.

Preferably, one or more mid layers are provided between the core and the cover. Preferably, the base polymer of the mid layer that is in contact with the core is an ionomer resin.

Preferably, the cover has a Shore D hardness of 20 or greater and 50 or less.

Accordingly, golf balls that are superior in spin stability upon approach shots and flight distance upon shots with a driver.

BRIEF DESCRIPTION OF THE DRAWINGS

FIG. 1 is a partially cut off cross-sectional view illustrating a golf ball according to one embodiment of the present invention.

DESCRIPTION OF THE PREFERRED EMBODIMENTS

Hereinafter, the present invention will be described in detail according to the preferred embodiments with appropriate references to the accompanying drawing.

Golf ball 2 shown in FIG. 1 has core 4, mid layer 6 provided to cover the core 4, reinforcing layer 8 provided to cover the mid layer 6, and cover 10 provided to cover the reinforcing layer 8. The core 4 is spherical. A large number of dimples 12 are formed on the surface of the cover 10. Of the surface of the cover 10, a part other than the dimples 12 is land 14. This golf ball 2 has paint layer 16 on the external side of the cover 10 (see, enlarged portion in FIG. 1). A mark layer is provided on the external side of the cover 10, although this mark layer is not shown in the FIGURE.

This golf ball 2 has a diameter of from 40 mm to 45 mm. From the standpoint of conformity to a rule defined by United States Golf Association (USGA), the diameter is preferably equal to or greater than 42.67 mm. In light of suppression of the air resistance, the diameter is preferably equal to or less than 44 mm, and more preferably equal to or less than 42.80 mm. The weight of this golf ball 2 is 40 g or greater and 50 g or less. In light of attainment of great inertia, the weight is preferably equal to or greater than 44 g, and more preferably equal to or greater than 45.00 g. From the standpoint of conformity to a rule defined by USGA, the weight is preferably equal to or less than 45.93 g.

The core 4 is commonly obtained through crosslinking of a rubber composition. Examples of preferable base rubber include polybutadienes, polyisoprenes, styrene-butadiene copolymers, ethylene-propylene-diene copolymers and natural rubbers. In light of the resilience performance, polybutadienes are preferred.

When other rubber is used in combination with polybutadiene, it is preferred that the polybutadiene is included as a principal component. Specifically, it is preferred that percentage of polybutadiene occupying the entire base rubber is equal to or greater than 50% by weight, and particularly equal to or greater than 80% by weight. Polybutadienes having a percentage of cis-1,4 bonds of equal to or greater than 40%, and particularly equal to or greater than 80% are particularly preferred.

For crosslinking of the core 4, a co-crosslinking agent is commonly used. Preferable examples of the co-crosslinking agent in light of the resilience performance include monovalent or bivalent metal salts of an α,β-unsaturated carboxylic acid having 2 to 8 carbon atoms. Specific examples of the preferable co-crosslinking agent include zinc acrylate, magnesium acrylate, zinc methacrylate and magnesium methacrylate. Zinc acrylate and zinc methacrylate are particularly preferred on the grounds that a high resilience performance can be achieved.

As a co-crosslinking agent, an α,β-unsaturated carboxylic acid having 2 to 8 carbon atoms, and a metal oxide may be blended. Both components react in the rubber composition to give a salt. This salt is responsible for the crosslinking reaction. Examples of preferable α,β-unsaturated carboxylic acid include acrylic acid and methacrylic acid. Examples of preferable metal oxide include zinc oxide and magnesium oxide.

The amount of the co-crosslinking agent blended is preferably 10 parts by weight or greater and 50 parts by weight or less per 100 parts by weight of the base rubber. When the amount is below the above range, the resilience performance of the golf ball 2 may be insufficient. In this respect, the amount is more preferably equal to or greater than 15 parts by weight. When the amount is beyond the above range, hard feel at impact of the golf ball 2 may be experienced. In this respect, the amount is more preferably equal to or less than 45 parts by weight.

Into the rubber composition for use in the core 4, an organic peroxide may be preferably blended together with the co-crosslinking agent. The organic peroxide serves as a crosslinking initiator. By blending an organic peroxide, the resilience performance of the golf ball 2 may be improved. Examples of suitable organic peroxide include dicumyl peroxide, 1,1-bis(t-butylperoxy)-3,3,5-trimethylcyclohexane, 2,5-dimethyl-2,5-di(t-butylperoxy)hexane and di-t-butyl peroxide. Particularly versatile organic peroxide is dicumyl peroxide.

The amount of the blended organic peroxide is preferably 0.1 parts by weight or greater and 3.0 parts by weight or less per 100 parts by weight of the base rubber. When the amount is below the above range, the resilience performance of the golf ball 2 may be insufficient. In this respect, the amount is more preferably equal to or greater than 0.3 parts by weight, and particularly preferably equal to or greater than 0.5 parts by weight. When the amount is beyond the above range, hard feel at impact of the golf ball 2 may be experienced. In this respect, the amount is more preferably equal to or less than 2.5 parts by weight.

In the core 4 may be blended a filler for the purpose of adjusting the specific gravity and the like. Illustrative examples of suitable filler include zinc oxide, barium sulfate, calcium carbonate and magnesium carbonate. Powder of a highly dense metal may be also blended as the filler. Specific examples of the highly dense metal include tungsten and molybdenum. The amount of the blended filler is determined ad libitum so that the intended specific gravity of the core 4 can be accomplished. Particularly preferable filler is zinc oxide. Zinc oxide serves not only to merely adjust the specific gravity but also as a crosslinking activator. Various kinds of additives such as sulfur, a sulfur compound, an anti-aging agent, a coloring agent, a plasticizer, a dispersant and the like may be blended at an adequate amount in the core 4 as needed. In the core 4 may be also blended crosslinked rubber powder or synthetic resin powder.

The amount of compressive deformation P1 of the core 4 is preferably equal to or less than 5.0 mm, more preferably equal to or less than 4.5 mm, and particularly preferably equal to or less than 4.0 mm. Upon hitting of the golf ball 2 with a driver, the core 4 is also deformed greatly along with the cover 10 and the mid layer 6. The core 4 having a small amount of compressive deformation P1 is responsible for the flight performance upon shots with a driver. When the amount of compressive deformation P1 is too small, feel at impact may be deteriorated. In light of the feel at impact, the amount of compressive deformation P1 is more preferably equal to or greater than 1.5 mm, and particularly preferably equal to or greater than 2.0 mm.

Upon measurement of the amount of compressive deformation, a spherical body is first placed on a metal hard plate. Next, a cylinder made of metal gradually descends toward the spherical body. The spherical body intervened between the bottom face of the cylinder and the hard plate is deformed. A migration distance of the cylinder, starting from the state in which an initial load of 98 N is applied to the spherical body up to the state in which a final load of 1274 N is applied thereto is the amount of compressive deformation. Illustrative examples of the spherical body subjected to the measurement of the amount of compressive deformation include the core 4, a spherical body including the core 4 and mid layer 6, and a spherical body further provided with the cover 10.

The core 4 has a diameter of 25 mm or greater and 41.5 mm or less. The core 4 has a weight of preferably 25 g or greater and 42 g or less. The crosslinking temperature of the core 4 is usually 140° C. or higher and 180° C. or lower. The crosslinking time period of the core 4 is usually 10 minutes or longer and 60 minutes or shorter.

In this embodiment, a mid layer 6 is provided. Alternatively, the mid layer 6 may not be provided. When the mid layer 6 is provided, the mid layer 6 may be composed of either one layer, or two or more layers.

It should be noted that the mid layer 6 herein means a layer situated between the core 4 and the cover 10. According to the terminology used by persons skilled in the art, the mid layer may refer to a part of a core, or the mid layer may refer to a part of a cover. However, the mid layer herein is included neither in the core, nor in the cover. The cover herein is only one layer that is in contact with the paint layer.

A thermoplastic resin composition is suitably used in the mid layer 6. Examples of the base polymer of this resin composition include ionomer resins, thermoplastic polyester elastomers, thermoplastic polyamide elastomers, thermoplastic polyurethane elastomers, thermoplastic polyolefin elastomers and thermoplastic polystyrene elastomers. In particular, ionomer resins are preferred. The ionomer resins are highly elastic. The ionomer resin is responsible for the flight performance upon shots with a driver.

The ionomer resin and other resin may be used in combination. When they are used in combination, the ionomer resin is included as the principal component of the base polymer, in light of the flight performance. Proportion of the ionomer resin in the total base polymer accounts for preferably equal to or greater than 50% by weight, more preferably equal to or greater than 70% by weight, and particularly preferably equal to or greater than 85%.

An ionomer resin prepared by neutralizing a part of carboxylic acid in a copolymer formed with α-olefin and an α,β-unsaturated carboxylic acid having 3 to 8 carbon atoms with a metal ion is preferably used. Preferred α-olefin is ethylene and propylene. Preferred α,β-unsaturated carboxylic acid is acrylic acid and methacrylic acid. Illustrative examples of the metal ion for use in neutralization include sodium ion, potassium ion, lithium ion, zinc ion, calcium ion, magnesium ion, aluminum ion and neodymium ion. The neutralization may be carried out with two or more kinds of metal ions. Particularly suitable metal ion in light of the resilience performance and durability of the golf ball 2 is sodium ion, zinc ion, lithium ion and magnesium ion.

Specific examples of the ionomer resin include trade names "Himilan® 1555", "Himilan® 1557", "Himilan® 1605", "Himilan® 1706", "Himilan® 1707", "Himilan® AM7329", "Himilan® AM7311", "Himilan® AM7315", "Himilan® AM7317", "Himilan® AM7318" and "Himilan® MK7320", available from Du Pont-MITSUI POLYCHEMICALS Co., Ltd.; trade names "Surlyn® 7930", "Surlyn® 7940", "Surlyn® 8140", "Surlyn® 8940", "Surlyn® 8945", "Surlyn® 9120", "Surlyn® 9910" and "Surlyn® 9945", available from Dupont; and trade names "IOTEK 7010", "IOTEK 7030", "IOTEK 8000" and "IOTEK 8030", available from EXXON Corporation.

In the resin composition of the mid layer 6 may be blended a filler for the purpose of adjusting the specific gravity and the like. Illustrative examples of suitable filler include zinc oxide, barium sulfate, calcium carbonate and magnesium carbonate. Powder of a highly dense metal may be also blended as the filler. Specific examples of the highly dense metal include tungsten and molybdenum. The amount of the blended filler is determined ad libitum so that intended specific gravity of the mid layer 6 can be accomplished. In the mid layer 6 may be also blended a coloring agent, crosslinked rubber powder or synthetic resin powder.

In light of the flight performance upon shots with a driver, Shore D hardness Hm of the mid layer 6 is preferably equal to or greater than 55, more preferably equal to or greater than 58, and particularly preferably equal to or greater than 60. When the Shore D hardness Hm is extraordinarily large, good feeling is less likely to be experienced upon hitting of the golf ball 2. In this respect, the Shore D hardness Hm is preferably equal to or less than 72, more preferably equal to or less than 70, and particularly preferably equal to or less than 68.

The Shore D hardness Hm of the mid layer 6 and the Shore D hardness Hc of the cover 10 may be measured in accordance with a standard of "ASTM-D 2240-68". For the measurement, an automated rubber hardness scale which is equipped with a Shore D type spring hardness scale (trade name "LA1", available from Koubunshi Keiki Co., Ltd.) is used. Upon the measurement, a sheet which was formed by hot press is used having a thickness of about 2 mm and consisting of the same material as that of the mid layer 6 (or the cover 10). Prior to the measurement, the sheet is stored at a temperature of 23° C. for two weeks. When the measurement is carried out, three sheets are overlaid.

The mid layer 6 has a thickness Tm of preferably 0.3 mm or greater and 2.5 mm or less. When the thickness Tm is below the above range, the flight performance upon shots with a driver may be unsatisfactory. In this respect, the thickness Tm is more preferably equal to or greater than 0.5 mm, and particularly preferably equal to or greater than 0.7 mm. When the thickness Tm exceeds the above range, favorable feeling is less likely to be experienced upon hitting of the golf ball 2. In this respect, the thickness Tm is more preferably equal to or less than 2.0 mm.

In light of adhesion between the mid layer 6 and the reinforcing layer 8 or the cover 10, the surface of the mid layer 6 is preferably subjected to a treatment, whereby the roughness thereof is increased. Specific examples of the treatment include brushing, grinding and the like.

The reinforcing layer 8 lies between the mid layer 6 and the cover 10, and improves adhesiveness therebetween. In particular, when the golf ball 2 has a extremely thin cover 10, a wrinkle is liable to be generated upon hitting of the thin cover 10 with an edge of a clubface. The reinforcing layer 8 suppresses generation of such a wrinkle.

For the base polymer of the reinforcing layer 8, a two-pack type thermosetting resin may be suitably used. Specific examples of the two-pack type thermosetting resin include epoxy resins, urethane resins, acrylic resins, polyester based resins and cellulose based resins. In light of the mechanical strength (e.g., strength at break) and durability of the reinforcing layer 8, two-pack type epoxy resins and two-pack type urethane resins are preferred.

The two-pack type epoxy resin is obtained by curing an epoxy resin with a polyamide based curing agent. Illustrative examples of the epoxy resin for use in the two-pack type epoxy resin include bisphenol A type epoxy resins, bisphenol F type epoxy resins and bisphenol AD type epoxy resins. The bisphenol A type epoxy resin is obtained by a reaction of bisphenol A with an epoxy group-containing compound such as epichlorohydrin. The bisphenol F type epoxy resin is obtained by a reaction of bisphenol F with an epoxy group-containing compound. The bisphenol AD type epoxy resin is obtained by a reaction of bisphenol AD with an epoxy group-containing compound. In light of the balance among softness, chemical resistance, heat resistance and toughness, the bisphenol A type epoxy resins are preferred.

The polyamide based curing agent has multiple amino groups and one or more amide groups. This amino group can react with an epoxy group. Specific examples of the polyamide based curing agent include polyamide amine curing agents and modified products of the same. The polyamide amine curing agent is obtained by a condensation reaction of a polymerized fatty acid with a polyamine. Typical polymerized fatty acid may be obtained by heating natural fatty acids containing a large amount of an unsaturated fatty acid such as linoleic acid, linolenic acid or the like in the presence of a catalyst to perfect the synthesis. Specific examples of the unsaturated fatty acid include tall oil, soybean oil, linseed oil and fish oil. Polymerized fatty acids having a dimer content of equal to or greater than 90% by weight and a trimer content of equal to or less than 10% by weight, and being hydrogenated are preferred. Illustrative examples of preferred polyamine include polyethylene diamine, polyoxyalkylene diamine and derivatives thereof.

Upon mixing of the epoxy resin and the polyamide based curing agent, ratio of epoxy equivalent of the epoxy resin and amine active hydrogen equivalent of the polyamide based curing agent is preferably 1.0/1.4 or greater and 1.0/1.0 or less.

The two-pack type urethane resin is obtained by a reaction of a base material and a curing agent. A two-pack type urethane resin obtained by a reaction of a base material containing a polyol component with a curing agent containing polyisocyanate or a derivative thereof, or a two-pack type urethane resin obtained by a reaction of a base material containing an isocyanate group-ended urethane prepolymer with a curing agent having an active hydrogen may be used. In particular, two-pack type urethane resins prepared by a reaction of a base material containing a polyol component with a curing agent containing polyisocyanate or a derivative thereof are preferred.

It is preferred that urethane polyol be used as the polyol component of the base material. The urethane polyol has urethane bonds and at least two hydroxyl groups. Preferably, the urethane polyol has a hydroxyl groups at its end. The urethane polyol can be obtained by allowing polyol and polyisocyanate to react at a ratio by which an excess molar ratio of the hydroxyl groups of the polyol component to the isocyanate groups of polyisocyanate is provided.

The polyol for use in production of the urethane polyol has multiple hydroxyl groups. Polyols having a weight average molecular weight of 50 or greater and 2,000 or less, and particularly 100 or greater and 1,000 or less are preferred. Examples of the polyol having a low molecular weight include diols and triols. Specific examples of the diol include ethylene glycol, diethylene glycol, triethylene glycol, 1,3-butanediol, 1,4-butanediol, neopentyl glycol and 1,6-hexanediol. Specific examples of the triol include trimethylolpropane and hexanetriol. Examples of the polyol having a high molecular weight include polyether polyols such as polyoxyethylene glycol (PEG), polyoxypropylene glycol (PPG) and polyoxytetramethylene glycol (PTMG); condensed polyester polyols such as polyethylene adipate (PEA), polybutylene adipate (PBA) and polyhexamethylene adipate (PHMA); lactone based polyester polyols such as poly-ϵ-caprolactone (PCL); polycarbonate polyols such as polyhexamethylene carbonate; and acrylic polyols. Two or more kinds of the polyols may be used in combination.

The polyisocyanate for use in production of the urethane polyol has multiple isocyanate groups. Specific examples of the polyisocyanate include aromatic polyisocyanates such as 2,4-toluene diisocyanate, 2,6-toluene diisocyanate, mixtures of 2,4-toluene diisocyanate and 2,6-toluene diisocyanate (TDI), 4,4'-diphenylmethane diisocyanate (MDI), 1,5-naphthylene diisocyanate (NDI), 3,3'-bitolylene-4,4'-diisocyanate (TODI), xylylene diisocyanate (XDI), tetramethylxylylene diisocyanate (TMXDI) and paraphenylene diisocyanate (PPDI); alicyclic polyisocyanates such as 4,4'-dicyclohexylmethane diisocyanate ($H_{12}$MDI), hydrogenated xylylene diisocyanate ($H_6$XDI), hexamethylene diisocyanate (HDI) and isophorone diisocyanate (IPDI); and aliphatic polyisocyanates. Two or more polyisocyanates may be used in combination. In light of the weather resistance, TMXDI, XDI, HDI, $H_6$XDI, IPDI and $H_{12}$MDI are preferred.

In the reaction of the polyol and polyisocyanate for producing the urethane polyol, any known catalyst can be used. Typical catalyst may be dibutyltin dilaurate.

In light of strength of the reinforcing layer 8, the ratio of the urethane bonds included in the urethane polyol is preferably equal to or greater than 0.1 mmol/g. In light of the following capability of the reinforcing layer 8 to the cover, the ratio of the urethane bonds included in the urethane polyol is preferably equal to or less than 5 mmol/g. The ratio of the urethane bonds may be adjusted by regulating the molecular weight of the polyol to be a raw material, and by regulating compounding ratio of the polyol and the polyisocyanate.

In light of a short time period required for the reaction of the base material with the curing agent, the urethane polyol has a weight average molecular weight of preferably equal to or greater than 4,000, and more preferably equal to or greater than 4,500. In light of the adhesiveness of the reinforcing layer 8, the urethane polyol has a weight average molecular weight of preferably equal to or less than 10,000, and more preferably equal to or less than 9,000.

In light of the adhesiveness of the reinforcing layer 8, the urethane polyol has a hydroxyl value (mgKOH/g) of preferably equal to or greater than 15, and more preferably equal to or greater than 73. In light of a short time period required for the reaction of the base material with the curing agent, the urethane polyol has a hydroxyl value of preferably equal to or less than 130, and more preferably equal to or less than 120.

The base material may contain, in addition to the urethane polyol, a polyol not having any urethane bond. The aforementioned polyol as the raw material of the urethane polyol may be used in the base material. Polyols that are miscible with the urethane polyol are preferred. In light of a short time period required for the reaction of the base material with the curing agent, the proportion of the urethane polyol in the base material is preferably equal to or greater than 50% by weight, and more preferably equal to or greater than 80% by weight based on the solid content. Ideally, this proportion is 100% by weight.

The curing agent contains polyisocyanate or a derivative thereof. The aforementioned polyisocyanate as the raw material of the urethane polyol may be used in the curing agent.

The reinforcing layer 8 may include additives such as a coloring agent (typically, titanium dioxide), a phosphate based stabilizer, an antioxidant, a light stabilizer, a fluorescent brightening agent, an ultraviolet absorbent, a blocking preventive agent and the like. The additive may be added either to the base material of the two-pack type thermosetting resin, or to the curing agent.

The reinforcing layer 8 is obtained by coating a liquid, which is prepared by dissolving or dispersing a base material and a curing agent in a solvent, on the surface of the mid layer 6. In light of the workability, coating with a spray gun is preferred. The solvent is volatilized after the coating to permit a reaction of the base material with the curing agent thereby forming the reinforcing layer 8. Illustrative examples of preferred solvent include toluene, isopropyl alcohol, xylene, methyl ethyl ketone, methyl isobutyl ketone, ethylene glycol monomethyl ether, ethylbenzene, propylene glycol monomethyl ether, isobutyl alcohol and ethyl acetate.

In light of suppression of the wrinkle, the reinforcing layer 8 has a thickness of preferably equal to or greater than 3 μm, and more preferably equal to or greater than 5 μm. In light of easy formation of the reinforcing layer 8, it is preferred that the thickness is equal to or less than 300 μm, still more, equal to or less than 100 μm, yet more, equal to or less than 50 μm, and further, equal to or less than 20 μm. The thickness is measured by observation of the cross section of the golf ball 2 with a micro scope. When the surface of the mid layer 6 has roughness resulting from the surface roughening treatment, the thickness is measured immediately above the protruded portion.

In light of suppression of the wrinkle, the reinforcing layer 8 has a pencil hardness of preferably equal to or greater than 4B, and more preferably equal to or greater than B. In light of small loss of the force during its transfer from the cover 10 to the mid layer 6 upon hitting of the golf ball 2, the reinforcing layer 8 has a pencil hardness of preferably equal to or less than 3H. The pencil hardness is measured in accordance with a standard of "JIS K5400".

The reinforcing layer 8 may not be necessarily provided. When sufficient adhesion between the mid layer 6 and the cover 10 is accomplished leading to less possibility to generate the wrinkle, the reinforcing layer 8 may not be provided. In addition, also in the case in which the mid layer 6 is not provided, the reinforcing layer 8 may not be provided when the core 4 is adhered to the cover 6 enough.

As the base polymer of the cover 10, a urethane resin is used. Resulting from the presence of the urethane resin, the backspin rate upon approach shots is increased. In light of the formability, a thermoplastic polyurethane elastomer is preferred as the base polymer of the cover 10. The thermoplastic polyurethane elastomers are soft. A great spin rate is achieved upon hitting the golf ball 2 having a cover 10 constituted with a thermoplastic polyurethane elastomer, with a short iron. The cover 10 constituted with a thermoplastic polyurethane elastomer is responsible for a control performance upon shots with a short iron. The golf ball 2 having the cover 10 constituted with the thermoplastic polyurethane elastomer may contribute to the increase in the spin rate upon approach shots. The cover 10 constituted with the thermoplastic polyurethane elastomer is responsible for a control performance upon approach shots. The thermoplastic polyurethane elastomer is also responsible for the scuff resistance of the cover 10.

Other resin may be also used in combination with the thermoplastic polyurethane elastomer. In light of the control performance, the thermoplastic polyurethane elastomer is included in the base polymer as a principal component in the case of use in combination. The percentage of the thermoplastic polyurethane elastomer occupying in total base polymer is preferably equal to or greater than 50% by weight, more preferably equal to or greater than 70% by weight, and particularly preferably equal to or greater than 85% by weight.

The thermoplastic polyurethane elastomer includes a polyurethane component as a hard segment, and a polyester component or a polyether component as a soft segment. Illustrative examples of the curing agent for the polyurethane component include alicyclic diisocyanate, aromatic diisocyanate and aliphatic diisocyanate. In particular, alicyclic diisocyanate is preferred. Since the alicyclic diisocyanate has no double bond in the main chain, yellowing of the cover 10 can be suppressed. Additionally, because the alicyclic diisocyanate is excellent in strength, the cover 10 can be prevented from being scuffed. Two or more kinds of the diisocyanate may be used in combination.

Illustrative examples of the alicyclic diisocyanate include 4,4'-dicyclohexylmethane diisocyanate ($H_{12}$MDI), 1,3-bis (isocyanatomethyl)cyclohexane ($H_6$XDI), isophorone diisocyanate (IPDI) and trans-1,4-cyclohexane diisocyanate (CHDI). In light of versatility and processability, $H_{12}$MDI is preferred.

Illustrative examples of the aromatic diisocyanate include diphenylmethane diisocyanate (MDI) and toluene diisocyanate (TDI). Illustrative examples of the aliphatic diisocyanate include hexamethylene diisocyanate (HDI).

In light of versatility and cost, an MDI based thermoplastic polyurethane elastomer is preferred. The MDI based thermoplastic polyurethane elastomer is a thermoplastic polyurethane elastomer in which the curing agent is diphenylmethane diisocyanate (MDI). In light of versatility, 4,4'-diphenyl methane diisocyanate is more preferred among the diphenylmethane diisocyanate (MDI).

Specific examples of the thermoplastic polyurethane elastomer include trade name "Elastolan XNY90A", trade name "Elastolan XNY80A", trade name "Elastolan XNY97A", trade name "Elastolan XNY585" and trade name "Elastolan XKP016N", available from BASF Japan Ltd; and trade name "Rezamin P4585LS" and trade name "Rezamin PS62490" available from Dainichiseika Color & Chemicals Mfg. Co., Ltd.

Into the cover 10 may be blended a coloring agent such as titanium dioxide, a filler such as barium sulfate, a dispersant, an antioxidant, an ultraviolet absorbent, a light stabilizer, a fluorescent agent, a fluorescent brightening agent and the like in an appropriate amount as needed. The cover 10 may be also blended with powder of a highly dense metal such as tungsten, molybdenum or the like for the purpose of adjusting the specific gravity.

The cover 10 has a Shore D hardness Hc of equal to or less than 54. By employing a soft cover 10, satisfactory control performance upon shots with a short iron can be achieved. In light of the control performance, the hardness Hc is preferably equal to or less than 50, more preferably equal to or less than 47, and still more preferably equal to or less than 42. When the hardness is too low, the flight performance upon shots with a driver, a long iron and a middle iron may be insufficient. In this respect, it is preferred that the hardness Hc be equal to or greater than 20, further equal to or greater than 28, and still further equal to or greater than 33.

The cover 10 has a thickness Tc of equal to or less than 0.7 mm. As described above, the cover 10 has a low hardness. The cover 10 having a low hardness is disadvantageous in terms of the resilience coefficient of the golf ball 2. Upon shots with a driver, the mid layer 6 and the core 4 of the golf ball 2 are also deformed greatly. By setting the thickness Tc to be equal to or less than 0.7 mm, the cover 10 does not adversely affect the resilience coefficient to a large extent upon shots with a driver, even though the cover 10 has a low hardness. An excellent flight performance can be achieved upon shots with a driver through using the ionomer resin in the mid layer 6.

When the cover 10 has a low hardness, the backspin rate is likely to be increased upon shots with a driver. By setting the thickness Tc to be equal to or less than 0.7 mm, the backspin rate upon shots with a driver can be depressed even though the cover 10 has a low hardness, because the decreased thickness of the cover can increase the influences from the mid layer having a increased hardness. Due to the lower backspin rate, a great flight distance can be achieved upon shots with a driver.

In light of the flight distance, the thickness Tc is more preferably equal to or less than 0.6 mm, and more preferably equal to or less than 0.5 mm. When the thickness Tc is too small, the backspin rate is likely to be declined upon approach shots. In addition, when the thickness Tc is too small, difficulty in molding of the cover 10 may be involved. In these respects, the thickness Tc is preferably equal to or greater than 0.1 mm, more preferably equal to or greater than 0.15 mm, and still more preferably equal to or greater than 0.2 mm.

As shown in FIG. 1, the paint layer 16 includes two layers. The paint layer 16 had an internal paint layer 18, and an external paint layer 20. After application of the internal paint layer 18, the external paint layer 20 is applied. The internal paint layer 18 and the external paint layer 20 may have either the same composition, or different compositions. The paint layer 16 may include either three layers, or four or more layers. In light of the productivity, the paint layer 16 includes preferably three layers.

As the base polymer of the paint layer 16, for example, a urethane based resin and an epoxy based resin may be exemplified. These resins may be used in combination. When the paint layer 16 includes two layers, examples of the combination of [base polymer of internal paint layer 18: base polymer of external paint layer 20] include [urethane based resin: epoxy based resin], [urethane based resin: urethane based resin], [epoxy based resin: epoxy based resin] and [epoxy based resin: urethane based resin].

As the base polymer of the paint layer 16, a two-pack type urethane resin and a two-pack type epoxy resin are preferred.

The two-pack type epoxy resin is obtained by curing an epoxy resin with a polyamide based curing agent.

Illustrative examples of the epoxy resin for use in the two-pack type epoxy resin include bisphenol A type epoxy resins, bisphenol F type epoxy resins and bisphenol AD type epoxy resins. The bisphenol A type epoxy resin is obtained by a reaction of bisphenol A with an epoxy group-containing compound such as epichlorohydrin. The bisphenol F type epoxy resin is obtained by a reaction of bisphenol F with an epoxy group-containing compound. The bisphenol AD type epoxy resin is obtained by a reaction of bisphenol AD with an epoxy group-containing compound. In light of the balance among softness, chemical resistance, heat resistance and toughness, the bisphenol A type epoxy resins are preferred.

The polyamide based curing agent has multiple amino groups and one or more amide groups. This amino group can react with an epoxy group. Specific examples of the polyamide based curing agent include polyamide amine curing agents and modified products of the same. The polyamide amine curing agent is obtained by a condensation reaction of a polymerized fatty acid with a polyamine. Typical polymerized fatty acid may be obtained by heating natural fatty acids containing a large amount of an unsaturated fatty acid such as linoleic acid, linolenic acid or the like in the presence of a catalyst to perfect the synthesis. Specific examples of the unsaturated fatty acid include tall oil, soybean oil, linseed oil and fish oil. Polymerized fatty acids having a dimer content of equal to or greater than 90% by weight and a trimer content of equal to or less than 10% by weight, and being hydrogenated are preferred. Illustrative examples of preferred polyamine include polyethylene diamine, polyoxyalkylene diamine and derivatives thereof.

Upon mixing of the epoxy resin and the polyamide based curing agent, ratio of epoxy equivalent of the epoxy resin and amine active hydrogen equivalent of the polyamide based curing agent is preferably 1.0/1.4 or greater and 1.0/1.0 or less.

The two-pack type urethane resin is obtained by a reaction of a base material and a curing agent. A two-pack type urethane resin obtained by a reaction of a base material containing a polyol component with a curing agent containing polyisocyanate or a derivative thereof, or a two-pack type urethane resin obtained by a reaction of a base material containing an isocyanate group-ended urethane prepolymer with a curing agent having an active hydrogen may be used. In particular, two-pack type urethane resins prepared by a reaction of a base material containing a polyol component with a curing agent containing polyisocyanate or a derivative thereof are preferred.

It is preferred that urethane polyol be used as the polyol component of the base material. The urethane polyol has urethane bonds and at least two hydroxyl groups. Preferably, the urethane polyol has a hydroxyl groups at its end. The urethane polyol may be obtained by allowing polyol and polyisocyanate to react at a ratio by which an excess molar ratio of the hydroxyl groups of the polyol component to the isocyanate groups of polyisocyanate is provided.

The polyol for use in production of the urethane polyol has multiple hydroxyl groups. Polyols having a weight average molecular weight of 50 or greater and 2,000 or less, and particularly 100 or greater and 1,000 or less are preferred. Examples of the polyol having a low molecular weight include diols and triols. Specific examples of the diol include ethylene glycol, diethylene glycol, triethylene glycol, 1,3-butanediol, 1,4-butanediol, neopentyl glycol and 1,6-hexanediol. Specific examples of the triol include trimethylolpropane and hexanetriol. Examples of the polyol having a high molecular weight include polyether polyols such as polyoxyethylene glycol (PEG), polyoxypropylene glycol (PPG) and polyoxytetramethylene glycol (PTMG); condensed polyester polyols such as polyethylene adipate (PEA), polybutylene adipate (PBA) and polyhexamethylene adipate (PHMA); lactone based polyester polyols such as poly-ϵ-caprolactone (PCL); polycarbonate polyols such as polyhexamethylene carbonate; and acrylic polyols. Two or more kinds of the polyols may be used in combination.

The polyisocyanate for use in production of the urethane polyol has multiple isocyanate groups. Specific examples of the polyisocyanate include aromatic polyisocyanates such as 2,4-toluene diisocyanate, 2,6-toluene diisocyanate, mixtures of 2,4-toluene diisocyanate and 2,6-toluene diisocyanate (TDI), 4,4'-diphenylmethane diisocyanate (MDI), 1,5-naphthylene diisocyanate (NDI), 3,3'-bitolylene-4,4'-diisocyanate (TODI), xylylene diisocyanate (XDI), tetramethylxylylene diisocyanate (TMXDI) and paraphenylene diisocyanate (PPDI); alicyclic polyisocyanates such as 4,4'-dicyclohexylmethane diisocyanate ($H_{12}$MDI), hydrogenated xylylene diisocyanate ($H_6$XDI), hexamethylene diisocyanate (HDI) and isophorone diisocyanate (IPDI); and aliphatic polyisocyanates. Two or more polyisocyanates may be used in combination. In light of the weather resistance, TMXDI, XDI, HDI, $H_6$XDI, IPDI and $H_{12}$MDI are preferred.

In the reaction of the polyol and polyisocyanate for producing the urethane polyol, any known catalyst can be used. Typical catalyst may be dibutyltin dilaurate.

In light of the strength of the paint layer 16, ratio of the urethane bonds included in the urethane polyol is preferably equal to or greater than 0.1 mmol/g. In light of the following capability of the paint layer 16 to the cover, the ratio of the urethane bonds included in the urethane polyol is preferably equal to or less than 5 mmol/g. The ratio of the urethane bonds may be adjusted by regulating the molecular weight of the polyol to be a raw material, and by regulating compounding ratio of the polyol and the polyisocyanate.

In light of a short time period required for the reaction of the base material with the curing agent, the urethane polyol has a weight average molecular weight of preferably equal to or greater than 4,000, and more preferably equal to or greater than 4,500. In light of the adhesiveness of the paint layer 16, the urethane polyol has a weight average molecular weight of preferably equal to or less than 10,000, and more preferably equal to or less than 9,000.

In light of the adhesiveness of the paint layer 16, the urethane polyol has a hydroxyl value (mg KOH/g) of preferably equal to or greater than 15, more preferably equal to or greater than 40, still more preferably equal to or greater than 50, and yet more preferably equal to or greater than 73. In light of a short time period required for the reaction of the base material with the curing agent, the urethane polyol has a hydroxyl value of preferably equal to or less than 130, more preferably equal to or less than 120, and still more preferably equal to or less than 115.

The base material may contain, in addition to the urethane polyol, a polyol not having any urethane bond. The aforementioned polyol as the raw material of the urethane polyol may be used in the base material. Polyols that are miscible with the urethane polyol are preferred. In light of a short time period required for the reaction of the base material with the curing agent, the proportion of the urethane polyol in the base material is preferably equal to or greater than 50% by weight, and more preferably equal to or greater than 80% by weight based on the solid content. Ideally, this proportion is 100% by weight.

The curing agent contains polyisocyanate or a derivative thereof. The aforementioned polyisocyanate as the raw material of the urethane polyol may be used in the curing agent.

The paint layer 16 may include additives such as a coloring agent (typically, titanium dioxide), a phosphate based stabilizer, an antioxidant, a light stabilizer, a fluorescent brightening agent, an ultraviolet absorbent, a blocking preventive agent and the like. The additive may be added either to the base material of the two-pack type thermosetting resin, or to the curing agent.

The paint layer 16 is obtained by coating a liquid, which is prepared by dissolving or dispersing a base material and a curing agent in a solvent, on the surface of the mid cover 10. In light of the workability, coating with a spray gun is preferred. The solvent is volatilized after the coating to permit a reaction of the base material with the curing agent thereby forming the paint layer 16. Illustrative examples of preferred solvent include toluene, isopropyl alcohol, xylene, methyl ethyl ketone, methyl isobutyl ketone, ethylene glycol monomethyl ether, ethylbenzene, propylene glycol monomethyl ether, isobutyl alcohol and ethyl acetate.

In this embodiment, the paint layer 16 includes a plurality of layers. By providing the paint layer 16 including a plurality of layers, the paint layer 16 having a uniform thickness can be obtained irrespective of the thickness Tp being great.

In the present invention, the cover 10 has a small thickness Tc for achieving increase in the flight distance upon shots with a driver. According to the present invention, in golf balls provided with a urethane cover having a small thickness Tc, the ratio (Tp/Tc) is considered by providing a plurality of paint layers. By this golf ball, the dry spin rate Sd can be kept, while the wet spin rate Sw can be increased in connection with approach shots. According to such a golf ball spin stability upon approach shots can be improved.

In light of the spin stability upon approach shots, the paint layer has a thickness Tp of preferably equal to or greater than 15 μm, more preferably equal to or greater than 18 μm, and still more preferably equal to or greater than 20 μm. In light of improvement of the resilience performance upon shots with a driver while depressing the backspin rate upon shots with a driver, the paint layer has a thickness Tp of preferably equal to or less than 40 μm, more preferably equal to or less than 35 μm, and still more preferably equal to or less than 30 μm.

It was proven that the backspin upon approach shots is diminished when the urethane cover has a small thickness Tc. According to the present invention, due to the thickened paint layer, the backspin rate upon approach shots is likely to be increased even though the cover has a small thickness Tc.

The wet spin rate Sw shall be smaller as compared with the dry spin rate Sd. By the providing the paint layer having a thickness Tp of equal to or greater than 15 μm, slipping on the surface of the face of a wedge club is less likely to occur, whereby the wet spin rate Sw approximate to the dry spin rate Sd can be readily attained. Accordingly, high spin retention can be achieved. In light of the spin stability upon approach shots, the ratio (Tp/Tc) is preferably equal to or greater than 0.021, more preferably equal to or greater than 0.045, and still more preferably equal to or greater than 0.05. In light of depression of the backspin rate upon shots with a driver, along with improvement of the resilience performance upon shots with a driver, the paint layer has a thickness Tp of preferably equal to or less than 0.40, more preferably equal to or less than 0.30, and still more preferably equal to or less than 0.20.

In light of depression of the backspin rate upon shots with a driver or shots with an iron club, and achievement of a greater flight distance, the cover has a Shore D hardness Hc of equal to or greater than 20, and more preferably equal to or greater than 22. In light of increase in the backspin rate upon approach shots, the cover has a Shore D hardness Hc of equal to or less than 50, more preferably equal to or less than 45, and still more preferably equal to or less than 40.

In this embodiment, the paint layer is formed with two or more layers. The paint that constitutes each layer of the two or more layers may be either the same or different. The paint layer can include two layers by applying a single paint divided in two aliquots for application twice. By providing two layers for the paint layer, uniformity of the thickness Tp is likely to be achieved even though a greater thickness Tp is contemplated.

EXAMPLES

Hereinafter, advantages of the present invention will be explained by way of Examples, however, the present invention should not be construed as being limited based on the description of the Examples.

Example 1

A rubber composition was obtained by kneading 100 parts by weight of polybutadiene (trade name "BR-730", available from JSR Corporation), 39 parts by weight of zinc diacrylate, 5 parts by weight of zinc oxide, 0.5 parts by weight of diphenyl disulfide, 0.7 parts by weight of dicumyl peroxide and an adequate amount of barium sulfate. The compounded composition of this rubber composition is referred to as Core Compounded Composition 1. This rubber composition was placed into a mold having upper and lower mold half each having a hemispherical cavity, and heated under a temperature of 170° C. for 18 minutes to obtain a core having a diameter of 41.3 mm.

A resin composition was obtained by kneading 100 parts by weight of a thermoplastic polyurethane elastomer (Elastolan XNY90A, supra) and 4 parts by weight of titanium dioxide in a biaxial extruder. The compounded composition of this cover is referred to as Compounded Composition A. Half shells were obtained from this resin composition with compression molding. The core was covered by two pieces of the half shell. The core and half shells were placed into a final mold having a large number of pimples on its cavity face to obtain a cover having a thickness Tc of 0.7 mm by compression molding. Numerous dimples having a shape inverted from the shape of the pimple were formed on the cover.

A clear paint Y was prepared including a two-pack type epoxy resin as a base polymer. For preparation of the paint Y, trade name "POLIN 750LE" available from Shinto Paint Co., Ltd. was used. The paint Y was obtained by mixing 50 parts by weight of a POLIN 750LE base material, 50 parts by weight of a POLIN 750LE curing agent and 40 parts by weight of a POLIN 750LE thinner. The paint Y was applied on the surface of the cover with a spray gun, and kept in an atmosphere at 40° C. for 24 hrs to obtain a first paint layer (internal paint layer).

A clear paint X including a two-pack type polyurethane as a base was prepared. The base material of this paint X was a mixture of polyether polyol and polyester polyol. This base material had a hydroxyl value of 82 mg KOH/g. The curing agent of this paint X was hexamethylene diisocyanate. This paint had a NCO:OH equivalence ratio of 1.3:1.0. The paint X was applied on the cover, on which the paint Y had been applied, with a spray gun. The paint X was dried at a temperature of 40° C. for 120 min to give a second paint layer (external paint layer). Accordingly, a golf ball of Example 1 was obtained. This golf ball had a diameter of 42.7 mm, and a weight of 45.6 g. In the compounded composition of the core, the amount of the compounded barium sulfate was adjusted to give the golf ball having a weight of 45.6 g. Specifications and results of evaluation of the golf ball of Example 1 are presented in Table 4 below.

Example 2

A rubber composition was obtained by kneading 100 parts by weight of polybutadiene (trade name "BR-730", available from JSR Corporation), 39 parts by weight of zinc diacrylate, 5 parts by weight of zinc oxide, 0.5 parts by weight of diphenyl disulfide, 0.7 parts by weight of dicumyl peroxide and an adequate amount of barium sulfate. The compounded composition of this rubber composition is referred to as Core Compounded Composition 1. This rubber composition was placed into a mold having upper and lower mold half each having a hemispherical cavity, and heated under a temperature of 170° C. for 18 minutes to obtain a core having a diameter of 39.9 mm.

A resin composition was obtained by kneading 50 parts by weight of an ionomer resin (Himilan 1605, supra), 50 parts by weight of other ionomer resin (Himilan AM7329, supra), and 4 parts by weight of titanium dioxide in a biaxial extruder. The compounded composition of this rubber composition is referred to as Compounded Composition C. This resin composition was rendered to cover around the core by injection molding to obtain a mid layer. The mid layer had a thickness Tm of 1.2 mm.

A coating composition containing a two-pack type epoxy resin as a base polymer (trade name "POLIN 750LE", available from Shinto Paint Co., Ltd.) was prepared. The base material liquid of this coating composition consists of 30 parts by weight of a bisphenol A type solid epoxy resin and 70 parts by weight of a solvent. The curing agent liquid of this coating composition consists of 40 parts by weight of denatured polyamide amine, 55 parts by weight of a solvent and 5 parts by weight of titanium dioxide. The weight ratio of the base material liquid and the curing agent liquid is 1/1. This coating composition was coated on the surface of the mid layer with a spray gun, and kept in an atmosphere of 23° C. for 12 hours to give a reinforcing layer.

A resin composition was obtained by kneading 100 parts by weight of a thermoplastic polyurethane elastomer (Elastolan XNY80A, supra) and 4 parts by weight of titanium dioxide in a biaxial extruder. The compounded composition of this resin composition is referred to as Compounded Composition B. Half shells were obtained from this resin composition with compression molding. The spherical body including the core and the reinforcing layer was covered by two pieces of the half shell. The spherical body and half shells were placed into a final mold having a large number of pimples on its cavity face to obtain a cover having a thickness Tc of 0.2 mm by compression molding. Numerous dimples having a shape inverted from the shape of the pimple were formed on the cover.

The paint X was applied on the cover with a spray gun. The paint X was dried at a temperature of 40° C. for 120 min to give a first paint layer (internal paint layer). The paint X was applied on the cover, on which the paint X for the first paint layer had been applied, with a spray gun. The newly applied paint X was dried at a temperature of 40° C. for 120 min to give a second paint layer (external paint layer). Accordingly, a golf ball of Example 2 was obtained. This golf ball had a diameter of 42.7 mm, and a weight of 45.6 g. In the compounded composition of the core, the amount of the compounded barium sulfate was adjusted to give the golf ball having a weight of 45.6 g. Specifications and results of evaluation of the golf ball of Example 2 are presented in Table 4 below.

Example 3

A rubber composition was obtained by kneading 100 parts by weight of polybutadiene (trade name "BR-730", available from JSR Corporation), 34 parts by weight of zinc diacrylate, 5 parts by weight of zinc oxide, 0.5 parts by weight of diphenyl disulfide, 0.7 parts by weight of dicumyl peroxide and an adequate amount of barium sulfate. The compounded composition of this rubber composition is referred to as Core Compounded Composition 2. This rubber composition was placed into a mold having upper and lower mold half each having a hemispherical cavity, and heated under a temperature of 170° C. for 18 minutes to obtain a core having a diameter of 39.9 mm.

A resin composition was obtained by kneading 50 parts by weight of an ionomer resin (Himilan 1605, supra), 50 parts by weight of other ionomer resin (Himilan AM7329, supra), and 4 parts by weight of titanium dioxide in a biaxial extruder. The compounded composition of this rubber composition is referred to as Compounded Composition C. This resin composition was rendered to cover around the core by injection molding to obtain a mid layer. The mid layer had a thickness Tm of 0.9 mm.

A coating composition containing a two-pack type epoxy resin as a base polymer (trade name "POLIN 750LE", available from Shinto Paint Co., Ltd.) was prepared. The base material liquid of this coating composition consists of 30 parts by weight of a bisphenol A type solid epoxy resin and 70 parts by weight of a solvent. The curing agent liquid of this coating composition consists of 40 parts by weight of denatured polyamide amine, 55 parts by weight of a solvent and 5 parts by weight of titanium dioxide. The weight ratio of the base material liquid and the curing agent liquid is 1/1. This coating composition was coated on the surface of the mid layer with a spray gun, and kept in an atmosphere of 23° C. for 12 hours to give a reinforcing layer.

A resin composition was obtained by kneading 100 parts by weight of a thermoplastic polyurethane elastomer (Elastolan XNY90A, supra) and 4 parts by weight of titanium dioxide in a biaxial extruder. The compounded composition of this resin composition is referred to as Compounded Composition A. Half shells were obtained from this resin composition with compression molding. The spherical body including the core and the reinforcing layer was covered by two pieces of the half shell. The spherical body and half shells were placed into a final mold having a large number of pimples on its cavity face to obtain a cover having a thickness Tc of 0.5 mm by compression molding. Numerous dimples having a shape inverted from the shape of the pimple were formed on the cover.

The paint X was applied on the cover with a spray gun. The paint X was dried at a temperature of 40° C. for 120 min to form a first paint layer. The paint X was applied on the cover, on which the paint X for the first paint layer had been applied, with a spray gun. The newly applied paint X was dried at a temperature of 40° C. for 120 min to form a second paint layer. The paint X was applied on the cover, on which the paint X for the second paint layer had been applied, with a spray gun. The newly applied paint X was dried at a temperature of 40° C. for 120 min to form a third paint layer. Accordingly, a golf ball of Example 3 was obtained. This golf ball had a diameter of 42.7 mm, and a weight of 45.6 g. In the compounded composition of the core, the amount of the compounded barium sulfate was adjusted to give the golf ball having a weight of 45.6 g. Specifications and results of evaluation of the golf ball of Example 3 are presented in Table 4 below.

Example 4

A rubber composition was obtained by kneading 100 parts by weight of polybutadiene (trade name "BR-730", available from JSR Corporation), 39 parts by weight of zinc diacrylate, 5 parts by weight of zinc oxide, 0.5 parts by weight of diphenyl disulfide, 0.7 parts by weight of dicumyl peroxide and an adequate amount of barium sulfate. The compounded composition of this rubber composition is referred to as Core Compounded Composition 1. This rubber composition was placed into a mold having upper and lower mold half each having a hemispherical cavity, and heated under a temperature of 170° C. for 18 minutes to obtain a core having a diameter of 38.3 mm.

A resin composition was obtained by kneading 50 parts by weight of an ionomer resin (Himilan 1605, supra), 50 parts by weight of other ionomer resin (Himilan AM7329, supra), and 4 parts by weight of titanium dioxide in a biaxial extruder. The compounded composition of this rubber composition is referred to as Compounded Composition C. This resin composition was rendered to cover around the core by injection molding to obtain a mid layer. The mid layer had a thickness Tm of 1.9 mm.

A coating composition containing a two-pack type epoxy resin as a base polymer (trade name "POLIN 750LE", available from Shinto Paint Co., Ltd.) was prepared. The base material liquid of this coating composition consists of 30 parts by weight of a bisphenol A type solid epoxy resin and 70 parts by weight of a solvent. The curing agent liquid of this coating composition consists of 40 parts by weight of denatured polyamide amine, 55 parts by weight of a solvent and 5 parts by weight of titanium dioxide. The weight ratio of the base material liquid and the curing agent liquid is 1/1. This coating composition was coated on the surface of the mid layer with a spray gun, and kept in an atmosphere of 23° C. for 12 hours to give a reinforcing layer.

A resin composition was obtained by kneading 100 parts by weight of a thermoplastic polyurethane elastomer (Elastolan XNY80A, supra) and 4 parts by weight of titanium dioxide in a biaxial extruder. The compounded composition of this resin composition is referred to as Compounded Composition B. Half shells were obtained from this resin composition with compression molding. The spherical body including the core and the reinforcing layer was covered by two pieces of the half shell. The spherical body and half shells were placed into a final mold having a large number of pimples on its cavity face to obtain a cover having a thickness Tc of 0.3 mm by compression molding. Numerous dimples having a shape inverted from the shape of the pimple were formed on the cover.

The paint Y was applied on the cover with a spray gun, and kept in an atmosphere at 40° C. for 24 hrs to form a first paint layer. The paint Y was applied on the cover, on which the paint Y for the first paint layer had been applied, with a spray gun. The newly applied paint Y was kept in an atmosphere at 40° C. for 24 hrs to form a second paint layer. The paint X was applied on the cover, on which the paint Y for the second paint layer had been applied, with a spray gun. The newly applied paint X was dried at a temperature of 40° C. for 120 min to form a third paint layer. Accordingly, a golf ball of Example 4 was obtained. This golf ball had a diameter of 42.7 mm, and a weight of 45.6 g. In the compounded composition of the core, the amount of the compounded barium sulfate was adjusted to give the golf ball having a weight of 45.6 g. Specifications and results of evaluation of the golf ball of Example 4 are presented in Table 4 below.

Comparative Example 1

A rubber composition was obtained by kneading 100 parts by weight of polybutadiene (trade name "BR-730", available from JSR Corporation), 34 parts by weight of zinc diacrylate, 5 parts by weight of zinc oxide, 0.5 parts by weight of diphenyl disulfide, 0.7 parts by weight of dicumyl peroxide and an adequate amount of barium sulfate. The compounded composition of this rubber composition is referred to as Core Compounded Composition 2. This rubber composition was placed into a mold having upper and lower mold half each having a hemispherical cavity, and heated under a temperature of 170° C. for 18 minutes to obtain a core having a diameter of 39.4 mm.

A resin composition was obtained by kneading 50 parts by weight of an ionomer resin (Himilan 1605, supra), 50 parts by weight of other ionomer resin (Himilan AM7329, supra), and 4 parts by weight of titanium dioxide in a biaxial extruder. The compounded composition of this rubber composition is referred to as Compounded Composition C. This resin composition was rendered to cover around the core by injection molding to obtain a mid layer. The mid layer had a thickness Tm of 1.6 mm.

A coating composition containing a two-pack type epoxy resin as a base polymer (trade name "POLIN 750LE", available from Shinto Paint Co., Ltd.) was prepared. The base material liquid of this coating composition consists of 30 parts by weight of a bisphenol A type solid epoxy resin and 70 parts by weight of a solvent. The curing agent liquid of this coating composition consists of 40 parts by weight of denatured polyamide amine, 55 parts by weight of a solvent and 5 parts by weight of titanium dioxide. The weight ratio of the base material liquid and the curing agent liquid is 1/1. This coating composition was coated on the surface of the mid layer with a spray gun, and kept in an atmosphere of 23° C. for 12 hours to give a reinforcing layer.

A resin composition was obtained by kneading 100 parts by weight of a thermoplastic polyurethane elastomer (Elastolan XNY80A, supra) and 4 parts by weight of titanium dioxide in a biaxial extruder. The compounded composition of this resin composition is referred to as Compounded Composition B. Half shells were obtained from this resin composition with compression molding. The spherical body including the core and the reinforcing layer was covered by two pieces of the half shell. The spherical body and half shells were placed into a final mold having a large number of pimples on its cavity face to obtain a cover having a thickness Tc of 0.05 mm by compression molding. Numerous dimples having a shape inverted from the shape of the pimple were formed on the cover.

The paint Y was applied on the cover with a spray gun, and kept in an atmosphere at 40° C. for 24 hrs to form a first paint layer. The paint X was applied on the cover, on which the paint Y for the first paint layer had been applied, with a spray gun. The newly applied paint X was dried at a temperature of 40° C. for 120 min to form a second paint layer. Accordingly, a golf ball of Comparative Example 1 was obtained. This golf ball had a diameter of 42.7 mm, and a weight of 45.6 g. In the compounded composition of the core, the amount of the compounded barium sulfate was adjusted to give the golf ball having a weight of 45.6 g. Specifications and results of evaluation of the golf ball of Comparative Example 1 are presented in Table 4 below.

Comparative Example 2

A rubber composition was obtained by kneading 100 parts by weight of polybutadiene (trade name "BR-730", available from JSR Corporation), 39 parts by weight of zinc diacrylate, 5 parts by weight of zinc oxide, 0.5 parts by weight of diphenyl disulfide, 0.7 parts by weight of dicumyl peroxide and an adequate amount of barium sulfate. The compounded composition of this rubber composition is referred to as Core Compounded Composition 1. This rubber composition was placed into a mold having upper and lower mold half each having a hemispherical cavity, and heated under a temperature of 170° C. for 18 minutes to obtain a core having a diameter of 39.3 mm.

A resin composition was obtained by kneading 50 parts by weight of an ionomer resin (Himilan 1605, supra), 50 parts by weight of other ionomer resin (Himilan AM7329, supra), and 4 parts by weight of titanium dioxide in a biaxial extruder. The compounded composition of this rubber composition is referred to as Compounded Composition C. This resin composition was rendered to cover around the core by injection molding to obtain a mid layer. The mid layer had a thickness Tm of 1.1 mm.

A coating composition containing a two-pack type epoxy resin as a base polymer (trade name "POLIN 750LE", available from Shinto Paint Co., Ltd.) was prepared. The base material liquid of this coating composition consists of 30 parts by weight of a bisphenol A type solid epoxy resin and 70 parts by weight of a solvent. The curing agent liquid of this coating composition consists of 40 parts by weight of denatured polyamide amine, 55 parts by weight of a solvent and 5 parts by weight of titanium dioxide. The weight ratio of the base material liquid and the curing agent liquid is 1/1. This coating composition was coated on the surface of the mid layer with a spray gun, and kept in an atmosphere of 23° C. for 12 hours to give a reinforcing layer.

A resin composition was obtained by kneading 100 parts by weight of a thermoplastic polyurethane elastomer (Elastolan XNY90A, supra) and 4 parts by weight of titanium dioxide in a biaxial extruder. The compounded composition of this resin composition is referred to as Compounded Composition A. Half shells were obtained from this resin composition with compression molding. The spherical body including the core and the reinforcing layer was covered by two pieces of the half shell. The spherical body and half shells were placed into a final mold having a large number of pimples on its cavity face to obtain a cover having a thickness Tc of 0.6 mm by compression molding. Numerous dimples having a shape inverted from the shape of the pimple were formed on the cover.

The paint X was applied on the cover with a spray gun. The paint X was dried at a temperature of 40° C. for 120 min to give a first paint layer including single layer. Accordingly, a golf ball of Comparative Example 2 was obtained. This golf ball had a diameter of 42.7 mm, and a weight of 45.6 g. In the compounded composition of the core, the amount of the compounded barium sulfate was adjusted to give the golf ball having a weight of 45.6 g. Specifications and results of evaluation of the golf ball of Comparative Example 2 are presented in Table 4 below.

Comparative Example 3

A golf ball of Comparative Example 3 was obtained in a similar manner to Example 1 except that the compounded composition of the core, the diameter of the core, the thickness Tc of the cover and the thickness Tp of the paint layer were as shown in Table 4 below. The specifications and results of evaluation of the golf ball of Comparative Example 3 are presented in Table 4 below.

Comparative Example 4

A golf ball of Comparative Example 4 was obtained in a similar manner to Comparative Example 2 except that the diameter of the core, the thickness Tm of the mid layer, the compounded composition of the cover and the thickness Tc of the cover were as shown in Table 4 below. The specifications and results of evaluation of the golf ball of Comparative Example 4 are presented in Table 4 below.

The core compounded composition 1 and the core compounded composition 2 are shown in Table 1 below. The compounded compositions A and B of the cover, and the compounded composition C of the mid layer are presented in Table 2 below. The Shore D hardness Hm of the mid layer and the Shore D hardness Hc of the cover are presented in Table 2 and Table 4 below. The compounded composition of the paint X, and the compounded composition of the paint Y are presented in Table 3 below. Specifications and results of evaluation of Examples and Comparative Examples are presented in Table 4 below.

In the paint layer of Examples 1 and 2, and Comparative Examples 1 and 3, the thickness of the first layer was the same as the thickness of the second layer. In the paint layer of Examples 3 and 4, the thickness of the first layer, the thickness of the second layer, and the thickness of the third layer were all the same.

Surface Hardness Hh of Core

The surface hardness Hh is determined by pressing a JIS-C spring hardness scale on the surface of the core. For the measurement, an automated rubber hardness scale (trade name "P1", available from Koubunshi Keiki Co., Ltd.) which is equipped with this hardness scale is used. The results of the measurement are presented in Table 4 below.

Shore D Hardness Hm of Mid Layer, and Shore D Hardness Hc of Cover

Shore D Hardness was measured according to the method described above. The results of the measurement are presented in Table 2 and Table 4 below.

Amount of Compressive Deformation

The amount of compressive deformation was measured according to the method described above. The amount of compressive deformation P1 of the core is shown in Table 4 below. The amount of compressive deformation P2 of the spherical body provided with the cover is shown in Table 4 below.

Shot with Driver

A driver with a titanium alloy head was attached to a swing machine available from Golf Laboratory Co. Then the machine condition was set to give the head speed of 50 m/sec, and the golf balls were hit therewith. Accordingly, the backspin rate S1 immediately after the hitting, and the flight distance were measured. The flight distance means a distance from the launching point to the point where the ball stopped. Mean values of 10 times measurements are presented in Table 4 below.

Dry Spin Rate Sd

A sand wedge was attached to a swing machine available from Golf Laboratory Co. Then the machine condition was set to give the head speed of 21 m/sec, and the golf balls were hit therewith. Accordingly, the spin rate (rpm) immediately after the hitting was measured. Mean values of 10 times measurements are presented in Table 4 below.

Wet Spin Rate Sw

The wet spin rate Sw (rpm) was determined in a similar manner to the determination of the dry spin rate Sd except that wetting of the ball and the club face was permitted with water. Mean values of 10 times measurements are presented in Table 4 below.

Spin Retention Rs

Based on the determined dry spin rate Sd (rpm) and the wet spin rate Sw (rpm), the spin retention Rs was calculated according to the following formula. Thus derived spin retention Rs is shown in Table 4 below. As the spin retention Rs is greater, the golf ball is favorable due to superior spin stability.

$$Rs(\%)=[Sw/Sd]\times 100$$

TABLE 1

Compounded Composition of Core

| | 1 | 2 |
|---|---|---|
| BR-730 (Note 1) | 100 | 100 |
| Zinc diacrylate | 39 | 34 |
| Zinc oxide | 5 | 5 |
| Barium sulfate | adequate amount | adequate amount |
| DPDS (Note 2) | 0.5 | 0.5 |
| DCP (Note 3) | 0.7 | 0.7 |

The amount of the compounded barium sulfate was adjusted to give the golf ball having a weight of 45.6 g.

(Note 1) High-cis polybutadiene commercially available under trade name of "BR-730" from JSR Corporation (Note 2) Diphenyl disulfide (Note 3) Dicumyl peroxide manufactured by NOF Corporation

TABLE 2

Compounded Compositions of Cover and Mid Layer

| | A | B | C |
|---|---|---|---|
| Elastolan XNY90A | 100 | | |
| Elastolan XNY80A | | 100 | |
| Himilan 1605 | | | 50 |
| Himilan AM7329 | | | 50 |
| Titanium dioxide | 4 | 4 | 4 |
| Hardness (Shore-D) | 38 | 26 | 65 |

TABLE 3

Compounded Composition of Paint

| | X | Y |
|---|---|---|
| Urethane paint (NCO:OH = 1.3:1.0) | 100 | |
| POLIN #750LE base material | | 50 |
| POLIN #750LE curing agent | | 50 |
| POLIN #711LE thinner | | 40 |

TABLE 4

Specifications and Evaluation Results of Examples and Comparative Examples

| | | Example 1 | Example 2 | Example 3 | Example 4 | Comparative Example 1 | Comparative Example 2 | Comparative Example 3 | Comparative Example 4 |
|---|---|---|---|---|---|---|---|---|---|
| Core | Compounded composition | 1 | 1 | 2 | 1 | 2 | 1 | 2 | 1 |
| | Diameter (mm) | 41.3 | 39.9 | 39.9 | 38.3 | 39.4 | 39.3 | 38.9 | 37.3 |
| | Amount of compressive deformation P1 (mm) | 2.7 | 2.7 | 3.2 | 2.7 | 3.2 | 2.7 | 3.2 | 2.7 |
| | Surface hardness Hh | 84 | 84 | 82 | 84 | 82 | 84 | 82 | 84 |
| Mid layer | Compounded composition | — | C | C | C | C | C | — | C |
| | Thickness Tm (mm) | — | 1.2 | 0.9 | 1.9 | 1.6 | 1.1 | — | 2.2 |
| | Hardness Hm | — | 65 | 65 | 65 | 65 | 65 | — | 65 |
| Cover | Compounded composition | A | B | A | B | B | A | A | B |
| | Thickness Tc (mm) | 0.7 | 0.2 | 0.5 | 0.3 | 0.05 | 0.6 | 1.9 | 0.5 |
| | Amount of compressive deformation P2 (mm) | 2.6 | 2.3 | 2.9 | 2.0 | 2.6 | 2.3 | 3.1 | 1.8 |

TABLE 4-continued

Specifications and Evaluation Results of Examples and Comparative Examples

| | | Example 1 | Example 2 | Example 3 | Example 4 | Comparative Example 1 | Comparative Example 2 | Comparative Example 3 | Comparative Example 4 |
|---|---|---|---|---|---|---|---|---|---|
| | Hardness Hc | 38 | 26 | 38 | 26 | 26 | 38 | 38 | 26 |
| Paint layer | Paint (first layer) | Y | X | X | Y | Y | X | Y | X |
| | Paint (second layer) | X | X | X | Y | X | — | X | — |
| | Paint (third layer) | — | — | X | X | — | — | — | — |
| | Number of layers | two layers | two layers | three layers | three layers | two layers | one layer | two layers | one layer |
| | Thickness per layer (mm) | 0.014 | 0.0075 | 0.009 | 0.010 | 0.005 | 0.008 | 0.015 | 0.050 |
| | Thickness Tp (mm) | 0.028 | 0.015 | 0.027 | 0.030 | 0.010 | 0.008 | 0.030 | 0.050 |
| Tp/Tc | | 0.040 | 0.075 | 0.054 | 0.100 | 0.200 | 0.013 | 0.016 | 0.100 |
| Spin rate with driver S1 (rpm) | | 2200 | 2400 | 2000 | 2450 | 2100 | 2250 | 2800 | 2700 |
| Flight distance with driver (m) | | 268 | 270 | 271 | 269.5 | 271 | 270.5 | 258 | 264 |
| Dry spin rate Sd (rpm) | | 6700 | 6900 | 6500 | 6950 | 6300 | 6750 | 7150 | 7250 |
| Wet spin rate Sw (rpm) | | 4850 | 5200 | 4800 | 5300 | 4000 | 3750 | 5600 | 4600 |
| Spin retention Rs (%) | | 72 | 75 | 74 | 76 | 63 | 56 | 78 | 63 |

As shown in Table 4, Examples received higher evaluation as compared with Comparative Examples. Therefore, advantages of the present invention are clearly suggested by these results of evaluation. The present invention can be applied to any and all golf balls. The foregoing description is just for illustrative examples, therefore, various modifications can be made in the scope without departing from the principles of the present invention.

What is claimed is:

1. A golf ball which comprises a core, a cover situated on the external side of the core, and a paint layer provided to cover the cover, wherein:

the base polymer of the cover is a urethane resin;

the base polymer of the paint layer is a two-pack type urethane resin or a two-pack type epoxy resin;

the cover has a thickness Tc of 0.1 mm or greater and 0.7 mm or less;

the paint layer has a thickness Tp (mm) of 0.015 mm or greater and 0.040 mm or less; and the ratio (Tp/Tc) is 0.021 or greater and 0.40 or less.

2. The golf ball according to claim 1, wherein the paint layer is formed with two or more layers.

3. The golf ball according to claim 1, wherein the base polymer of the cover is a thermoplastic polyurethane elastomer.

4. The golf ball according to claim 1, wherein one or more mid layers are provided between the core and the cover, and the base polymer of the mid layer that is in contact with the core is an ionomer resin.

5. The golf ball according to claim 1, wherein the cover has a Shore D hardness of 20 or greater and 50 or less.

6. The golf ball according to claim 1, wherein the paint layer is formed with two or more layers, and the paint that constitutes each layer of the two or more layers is the same.

7. The golf ball according to claim 1, wherein the cover has a thickness Tc of 0.1 mm or greater and 0.6 mm or less.

8. The golf ball according to claim 1, wherein the cover has a thickness Tc of 0.1 mm or greater and 0.5 mm or less.

9. The golf ball according to claim 1, wherein the ratio (Tp/Tc) is 0.045 or greater.

10. The golf ball according to claim 1, wherein the ratio (Tp/Tc) is 0.05 or greater.

11. The golf ball according to claim 1, wherein one or more mid layers are provided between the core and the cover, and the mid layer has a Shore D hardness of 55 or greater and 72 or less.

12. The golf ball according to claim 1, wherein one or more mid layers are provided between the core and the cover, and the mid layer has a thickness of 0.3 mm or greater and 2.5 mm or less.

13. The golf ball according to claim 1, wherein the base polymer of the cover contains 50% by weight or greater of a thermoplastic polyurethane elastomer; and wherein the base polymer of the paint layer is a two-pack type epoxy resin obtained by curing an epoxy resin with a polyamide based curing agent such that the ratio of epoxy equivalent of the epoxy resin to amine active hydrogen equivalent of the polyamide based curing agent is 1.0/1.4 or greater and 1.0/1.0 or less, or a two-pack type urethane resin obtained by a reaction of a base material containing a polyol component with a curing agent containing polyisocyanate or a derivative thereof such that the proportion of urethane polyol in the base material is 50% by weight or greater based on the solid content.

14. The golf ball according to claim 1, wherein the base polymer of the cover contains 85% by weight or greater of a thermoplastic polyurethane elastomer; and wherein the base polymer of the paint layer is a two-pack type epoxy resin obtained by curing an epoxy resin with a polyamide based curing agent such that the ratio of epoxy equivalent of the epoxy resin to amine active hydrogen equivalent of the polyamide based curing agent is 1.0/1.4 or greater and 1.0/1.0 or less, or a two-pack type urethane resin obtained by a reaction of a base material containing a polyol component with a curing agent containing polyisocyanate or a derivative thereof such that the proportion of urethane polyol in the base material is 80% by weight or greater based on the solid content.

15. The golf ball according to claim 1, wherein the cover has a thickness Tc of 0.2 mm or greater and 0.7 mm or less.

16. The golf ball according to claim 1, wherein the cover has a thickness Tc of 0.2 mm or greater and 0.5 mm or less.

17. The golf ball according to claim 4, wherein the mid layer has a thickness of 0.9 mm or greater and 1.9 mm or less.

18. The golf ball according to claim 1, wherein the paint layer is formed with two or three layers.

19. The golf ball according to claim 1, wherein the paint layer is formed with two layers, and a thickness per layer of the two layers is 0.0075 mm or greater and 0.014 mm or less.

20. The golf ball according to claim 1, wherein the paint layer is formed with three layers, and a thickness per layer of the three layers is 0.009 mm or greater and 0.010 mm or less.

* * * * *